US005441838A

United States Patent [19]

Pane

[11] Patent Number: 5,441,838

[45] Date of Patent: Aug. 15, 1995

[54] SIMULATED GLOSS PROCESS

[75] Inventor: Sharon G. Pane, Rochester, N.Y.

[73] Assignee: Xerox Corporation, Stamford, Conn.

[21] Appl. No.: 228,840

[22] Filed: Apr. 18, 1994

[51] Int. Cl.[6] ..... G03G 13/20

[52] U.S. Cl. ..... 430/97; 430/99; 430/124

[58] Field of Search ..... 430/97, 99, 124

[56] References Cited

U.S. PATENT DOCUMENTS

| | | | |
|---|---|---|---|
| 3,914,097 | 10/1975 | Wuri | 432/59 |
| 4,066,802 | 1/1978 | Clemens | 427/148 |
| 4,600,669 | 7/1986 | Ng et al. | 430/47 |
| 4,686,163 | 8/1987 | Ng et al. | 430/47 |
| 4,724,026 | 2/1988 | Nelson | 156/233 |
| 4,868,049 | 9/1989 | Nelson | 428/328 |
| 4,949,103 | 8/1990 | Schmidlin et al. | 346/150 |
| 5,065,183 | 11/1991 | Morofuji et al. | 355/202 |
| 5,108,865 | 4/1992 | Zwaldo et al. | 430/126 |
| 5,126,797 | 6/1992 | Forest et al. | 355/278 |
| 5,234,782 | 8/1993 | Aslam et al. | 430/99 |

FOREIGN PATENT DOCUMENTS

| | | | |
|---|---|---|---|
| 220066 | 9/1990 | Japan | 430/97 |
| 1016472 | 1/1966 | United Kingdom | 430/124 |
| 1559079 | 1/1980 | United Kingdom | 430/124 |

OTHER PUBLICATIONS

Method To Improve Color Copy And Transparency Quality, Moser, Xerox Discl. Jour., vol. 16, No. 5, Sep.-/Oct. 1991, p. 333.

*Primary Examiner*—Roland Martin

[57] ABSTRACT

High-gloss, flexible, protective overcoated documents are created using xerographic imaging. A transparent carrier having an adhesive on one side is positioned with the adhesived side of the carrier in contact with a xerographically imaged sheet. The two members are heated under pressure and the adhesive adheres to the imaged sheet. The carrier is then separated from the imaged sheet leaving a high-glossed sheet.

23 Claims, 4 Drawing Sheets

SIMULATED GLOSS PROCESS

BACKGROUND OF THE INVENTION

This invention relates generally to a method and apparatus for producing high-gloss coated xerographically produced color or black and white images, and more particularly, for overcoating printed book covers.

In the practice of conventional xerography, it is the general procedure to form electrostatic latent images on a xerographic surface by first uniformly charging a charge retentive surface such as a photoreceptor. The charged area is selectively dissipated in accordance with a pattern of activating radiation corresponding to original images. The selective dissipation of the charge leaves a latent charge pattern on the imaging surface corresponding to the areas not exposed by radiation.

This charge pattern is made visible by developing it with toner by passing the photoreceptor past one or more developer housings. In monochromatic imaging, the toner generally comprises black thermoplastic powder particles which adhere to the charge pattern by electrostatic attraction. The developed image is then fixed to the imaging surface or is transferred to a receiving substrate such as plain paper to which it is fixed by suitable fusing techniques.

Recently, there has been a great deal of effort directed to the development of color copiers/printers which utilize the xerographic process. Such efforts have resulted in the recent introduction of the Xerox TM 5775 TM copier/printer and the Fuji Xerox A-Color 635 machine.

The quality of color xerographic images on paper has approached the quality of color photographic prints. However, color xerographic prints fall short because they do not have the uniform gloss, dynamic range or brilliance typical of photographic prints. Nor do xerographic prints have the feel of photographic prints because the paper usually used is too lightweight and too limp.

Typically the surface of color toner images is irregular, therefore, rather rough or lumpy. The behavior of incident white light vis-a-vis such color images is believed to be as follows:

- Some of the white light incident on the substrate carrying the color toner images specularly reflects off the substrate.
- Some of the light goes down into the paper, scatters around and comes back out in various directions, some through the toner and some not.
- Because the toner surface is rough or irregular some of the light incident thereon is reflected off the toner in various directions.
- Some of the light incident on the irregular toner surfaces passes through the toner into the paper and comes back out in various directions.

White light becomes colored due to selective absorption as it passes through toner. The light then goes down into the paper and back out through the toner where it becomes more colored. As will be appreciated, any white light which does not pass through the toner diminishes the appearance of the final print.

Attempts to make up this deficiency in conventionally formed color toner images have led to the lamination of xerographic images on paper using a transparent substrate. This procedure has been only partially successful because the lamination process tends to reduce the density range of the print resulting in a print that has less shadow detail. The lamination process also adds significant weight and thickness to the print. In addition, laminations tend to separate when applied to a toner rich xerographic image while requiring trimming as a secondary step.

Additionally, it is believed that the aforementioned lamination process does not produce good results because typically the color toner images at the interface between the laminate and the toner do not make suitable optical contact. That is to say, the initially irregular toner image at the interface, is still irregular (i.e. contains voids) enough after lamination that light is reflected from at least some of those surfaces and is precluded from passing through the toner. In other words, when there are voids between the transparency and toner image, light gets scattered and reflected back without passing through the colored toner. Loss of image contrast results when any white light is scattered, either from the bottom surface of the transparent substrate or from the irregular toner surfaces and doesn't pass through the toner.

A known method of improving the gloss of color xerographic images on a transparent substrate comprises refusing the color images. Such a process was observed at a NOMDA trade show in 1985 at a Panasonic exhibit. The process exhibited was carried out using an off-line transparency fuser, available from Panasonic as model FA-F100, in connection with a color xerographic copier which was utilized for creating multi-color toner images on a transparent substrate for the purpose of producing colored slides. Since the finished image from the color copier was not really suitable for projection, it was refused using the aforementioned off-line refuser. To implement the process, the transparency is placed in a holder intermediate which consists of a clear relatively thin sheet of plastic and a more sturdy support. The holder is used for transporting the imaged transparency through the off-line refuser. The thin clear sheet is laid on top of the toner layer on the transparency. After passing out of the refuser, the transparency is removed from the holder. This process resulted in an attractive high gloss image useful in image projectors. The refuser was also used during the exhibit for refusing color images on paper. However, the gloss is image-dependent. Thus, the gloss is high in areas of high toner density because the toner refuses in contact with the clear plastic sheet and becomes very smooth. In areas where there is little or no toner the gloss is only that of the substrate.

The following is a discussion of prior art which may be relevant to the patentability of the present invention:

U.S. Pat. Nos. 4,686,163 and 4,600,669 describe an electrophotographic imaging method that uses an element comprising a photoconductive layer on an electrically conducting substrate capable of transmitting actinic radiation to which the photoconductive layer is responsive, and a dielectric support, releasably adhered to the substrate, comprising the photoconductive layer or an overcoat thereof forming a surface of the element capable of holding an applied electrostatic charge. To use the element, the surface of the dielectric support is charged, and the photoconductive layer is imagewise-exposed to actinic radiation, thereby forming a developable electrostatic image on the dielectric surface. The electrostatic image, in turn, is developed with toner to form a first color image. A composite color image is formed on the element by repeating the sequence one or more times with imagewise exposure of the photoconductive layer to actinic radiation transmitted through the substrate, and developing over each preceding image with a different color toner. The composite toner image is transferred with the dielectric support to a receiving element to form a color copy such as a three-color filter array or a color proof closely simulating the color print expected from a full press run.

The dielectric support on the photoconductive layer comprised a transparent blend of poly (vinylacetate-co-crotonic acid, 95/5 mole ratio) and cellulose acetate butyrate. The resulting multicolor proof presented a multicolor toner image against a white paper background and protected by the overlying dielectric support, thus accurately resembling a multicolor print from a full press run.

The receiver element to which the dielectric support and composite toner image are transferred can be any suitable material against or through which the toner image is desired to be viewed. The receiver can be print stock, such as paper, upon which a press run will be conducted. The receiver can also be of transparent material such as a polymeric film. With respect to the latter, the invention also contemplates, as an embodiment, transfer of the composite toner image and dielectric support to image-bearing elements such as microfilm or microfiche so that the composite color image forms information in addition to image information already present on such image-bearing elements. In addition, the invention contemplates the use of transparent glass or nonbirefringent translucent polymeric materials such as cellulose esters for use as the receiver. Receivers manufactured from such materials are suited for use in forming three-color filter arrays by the process described herein involving the formation of filter array matrices of the complementary colorants cyan, magenta and yellow in the respective color toner imaging steps. If desirable, the receiver can also contain a suitable overcoat layer adapted to soften under the influence of pressure and heat during the transfer step. In this manner, the adhesion of the dielectric support and composite toner image to the receiver can be enhanced.

The electrophotographic element bearing the multicolor toner image is moved to a separate lamination device comprising heated metal and rubber rolls, together forming a nip. The toner image is passed through the nip with and against a white receiver paper at a roll temperature of 100° C. (212° F.) and a pressure of 225 pounds per square inch (1.551 MPa) to effect transfer of the dielectric support and composite image to the receiver followed by peeling off the rest of the electrophotographic element.

U.S. Pat. No. 4,066,802 granted on Jan. 3, 1978 to Carl F. Clemens discloses a method of decalcomania in which a toner image pattern is formed on a transfer member which has been overcoated with an adhesive material. A polymeric sheet is interposed between the toner image and a cloth or other image receiving medium. The polymeric sheet assists in the permanent adherence of the toner imaging pattern to the cloth material or other medium when the composite is subjected to heat and pressure. The transfer member and method of its use are set forth. Another embodiment discloses the use of a solvent to fix the image to a cloth material.

U.S. Pat. No. 5,065,183 granted on Nov. 12, 1991 to Morofuji et al. discloses a multicolor printing method for printing multicolor picture images upon a material or object to be printed comprises the steps of, in accordance with a first embodiment of the invention, the formation of a multicolor toner image upon a flexible belt by means of electrophotographic printing methods or techniques, and the transfer of such multicolor toner image directly to the material or object to be printed, such as, for example, a container made of, for example, metal, paper, plastic, glass, or the like, by means of a thermo-transferring process. In accordance with a second embodiment of the invention, the multicolor toner image is formed upon a plastic film, which is laminated upon the flexible belt, by means of electrophotographic printing methods or techniques, and the plastic film is then transferred to and fused upon the container. In accordance with a third embodiment of the invention, a photoconductive member is irradiated by means of exposure light upon a rear surface thereof wherein the multicolor picture images are also formed by electrophotographic printing methods or techniques. In this manner, previously formed toner images upon the photoconductive member do not interfere with the image exposure processing.

U.S. Pat. No. 5,126,797 granted on Jun. 30, 1992 to Forest et al discloses a method and apparatus for laminating toner images wherein a toner image on a receiving sheet is laminated using a transparent laminating sheet fed from the normal copy sheet supply of a copier, printer or the like. The laminating sheet is fed into laminating contact with the toner image after the toner image has been formed on a receiving sheet. The resulting sandwich is fed through the fuser laminating the image between the sheets. The invention is particularly usable in forming color transparencies.

U.S. Pat. No. 5,108,865 granted to Zwaldo et al. on Apr. 28, 1992 discloses a method including the steps of:

contacting an image (preferably multi-toned image) with a transfer web (intermediate receptor layer) comprising in sequence, a carrier layer, a transferable release layer, and a releasable adhesive layer (releasable from the carrier layer along with the transferable release layer so that both layers transfer at once), said adhesive layer being in contact with said toned image, said contacting being done under sufficient heat and/or pressure to enable said toned image to be adhered to said releasable adhesive layer with greater strength than the adherence of said toned image to said imaging surface of said photoconductive layer;

separating the transfer web and said photoconductive layer so that the toned image is removed from said photoconductive layer and remains adhered to the adhesive layer of the transfer web; contacting the surface of the transfer web having both the multi-toned image and adhesive thereon with a permanent receptor surface;

adhering the adhesive on the transfer web to the permanent surface; and removing the carrier layer of the transfer web from the adhesive and the release layer of the transfer web so that an image article is formed of the permanent receptor, multi-toned image, releasable adhesive, and the resultant surface coating of the release layer which is furthest away from the permanent receptor.

U.S. Pat. No. 4,949,103 granted to Schmidlin et al. on Aug. 14, 1990 discloses a direct electrostatic printing (DEP) device utilized for printing mirror or reverse/- wrong reading toner images on a transparent substrate. An adhesive coating on the transparent substrate on the toner image side thereof enables the transparent substrate to be affixed to a substrate such as an envelope such that the mirror images are right reading.

U.S. Pat. Nos. 4,868,049 and 4,724,026 granted to Marshall A. Nelson on Feb. 9, 1988 and Sep. 19, 1989, respectively disclose selective metallic transfer foils for selectively transferring metallic foil to xerographic images on a receiving substrate such as paper. The transfer sheet comprises, in successive layers, a carrier film, a metallic film and an adhesive, the adhesive containing a dispersion of 0.5 micron or larger particulate material. A method is disclosed for forming images overlaid with metallic foil. According to the method of the invention, a sheet comprising xerographic images is provided and placed in face-to-face contact with a metal transfer sheet, to form a sandwich with the xerographic images on the inside. Heat and pressure are applied to the sandwich, causing the xerographic images to become tacky and causing the metallic foil to selectively adhere to the images. The remainder of the transfer sheet is then stripped away from the resulting decorated sheet comprising xerographic images overlaid with metallic foil.

In the preferred embodiment of the invention, the metal transfer sheet is provided with an adhesive of high filler content resin which has been found to produce good quality transfers to xerographic images produced by a wide variety of toners and photocopy machinery.

U.S. Pat. No. 3,914,097 granted to Donald R. Wurl on Oct. 21, 1975 discloses a sheet guide and cooling apparatus for preventing curl in sheets bearing a developed image, the image being permanently fixed to the sheet by application of heat and pressure. The apparatus is positioned to have a flat thermally conductive surface establishing a path for the sheet, downstream of the fixing area, the path extending in a plane substantially coplanar with the plane of sheet travel in the fixing station. Vacuum means associated with the surface maintains successive incremental portions of a sheet in face-to-face contact with the flat surface as it is being guided for at least a predetermined period as the sheet moves along the path and furthermore, provides a flow of cooling air for the surface.

Copending and commonly assigned U.S. patent application Ser. No. 08/095,639 filed on Jul. 21, 1993 discloses a method and apparatus for creating simulated photographic prints wherein a mirror image is formed on a transparent substrate. The transparent substrate has bonded thereto a backing sheet which serves as protection for the powder images on the transparent substrate as well as a reflective backing which significantly enhances the look of the images. The transparent substrate and backing sheet are bonded together by simultaneously passing the two members between a pair of heated rollers while simultaneously applying pressure.

Copending and commonly assigned U.S. patent application Ser. No. 08/095,622 filed on Jul. 21, 1993 discloses a device for creating simulated photographic prints. A transparent substrate to which a reverse reading image has been fused is uniformly coated on the image side thereof with a white material. A backing sheet is then adhered to the transparent substrate over the reverse reading image.

Copending and commonly assigned U.S. patent application Ser. No. 08/095,016 filed on Jul. 21, 1993 discloses a device for creating simulated photographic prints. As disclosed therein, a transparent substrate with a reverse reading toner image thereon is bonded to a backing sheet using heat and pressure provided by a pair of heat and pressure roller members. A second pair of rollers is provided downstream of the heat and pressure roll pair and receives the lead edge of a simulated photographic print and serves to pull the print in order to flatten it. A vacuum holddown transport downstream of the puller rolls serves to further flatten the print during a cool-down period.

Copending and commonly assigned U.S. patent application Ser. No. 08/095,136 filed on Sep. 27, 1993 discloses a device for creating simulated photographic prints wherein a transparent carrier having a xerographically formed mirror image fused thereto is bonded to a pair of plastic substrates through the use of heat and pressure. The transparent carrier and the plastic substrate form the finished print which exhibits an improved degree of flatness over other such prints.

Copending and commonly assigned U.S. patent application Ser. No. 08/095,788 filed on Jul. 21, 1993 discloses a kit for creating simulated photographic prints using xerographic imaging. The kit comprises a transparent carrier suitable for having a reverse reading toner image fused thereto and a reflective backing sheet, the latter of which is coated with a heat activatable adhesive material for bonding the latter to the former. The kit further includes a rigid surface of tempered glass upon which the transparent substrate is supported during bonding. An adhesive member is provided for covering the transparent carrier during the process of making prints.

Copending and commonly assigned U.S. patent application, Ser. No. 08/095,790, filed Jul. 21, 1993 discloses a high quality lamination process in which a transparency substrate is imaged (mirror image) and then the image side is laminated to a white never tear material. The never tear material includes a special adhesive which is activated by heat and pressure.

In a T-shirt application AB-X product marketed by Xerox Corporation, Rochester, N.Y., copies to be transferred to a T-shirt are made on the 5775 TM. In the process, an "A" sheet is imaged on the 5775 TM, transferred to a "B" sheet that is coated with a releasable adhesive, and then the "B" sheet image plus coating is transferred by heat and pressure to the T-shirt.

BRIEF SUMMARY OF THE INVENTION

The primary object of the present invention is to create simulated high-gloss, flexible, protective overcoated, xerographically printed covers for books whether color or black and white.

Another object of the invention is to create color photographic prints using xerography wherein the print has the look and feel of a conventional black and white or color photograph.

Yet another object of the invention is to provide for enhancement through an option for gloss or textured surface on the image side of a document.

Another object of the invention is to provide for improved fix or fuse level for both solid and liquid toned images.

A still further object of the invention is to provide improved resistance to damage on the imaged surface of a sheet from handling or contamination.

Yet another object of the invention is to provide for diminished post fuser curl on single sided imaged documents.

Another object of the invention is to provide for the avoidance of vinyl offset for styrene-acrylate based toners when copies are made from these toners are placed in vinyl ring binders.

Briefly, the present invention is carried out by first creating a multi-color or black and white toner image on an opaque substrate. The multi-color toner image is xerographically created by sequentially forming different color toner images on the opaque substrate followed by the use of heat and pressure or other suitable means to affix or fuse the multi-color image to the opaque substrate.

a smooth carrier member, which can be transparent, is provided with the carrier member including an adhesive gloss coat coating thereon that is heat transferred to the opaque substrate through heat an pressure.

The carrier member with the gloss coat coating is placed on top of the xerographic image and heated top platen is used to apply pressure and heat to the carrier member and the xerographic image on the opaque substrate. Afterwards, the carrier member is peeled off the imaged substrate leaving a high gloss protective coating thereon. The same process is used to coat xerographically images of photographs resulting in an attractive and brilliant appearance which is more fade resistance and durable than commercially available photographic prints. Prints created in the foregoing manner have the look and feel of photographic prints but appear to have more brilliance. This is thought to be attributable to the xerographically formed prints having a lesser minimum density than conventional photographic prints resulting in whiter whites.

A further aspect of this invention is that exceptionally good quality prints can be more quickly and more cost effectively produced than with conventional photographic printing techniques, especially in the case of larger size prints. Additionally, this process does not require silver, photographic chemicals, or intermediary negatives even when a black and white print is created from a color original.

Still another aspect of the present invention is the capability of creating a high quality black and white print from a color original without the need to create an intermediary negative as is the case with existing photographic methods. This attribute enhances the potential uses of the process by making it far more cost effective than photographic processes would be in this case.

Existing color xerographic copier/printer systems can be used for the process. Thus, all the resources associated with these products, particularly the ones which utilize state of the art electronic devices such as film scanners, image composition enhancers, color adjusters and editors can be utilized.

DETAILED DESCRIPTION OF THE PREFERRED EMBODIMENT OF THE INVENTION

Figure 1:
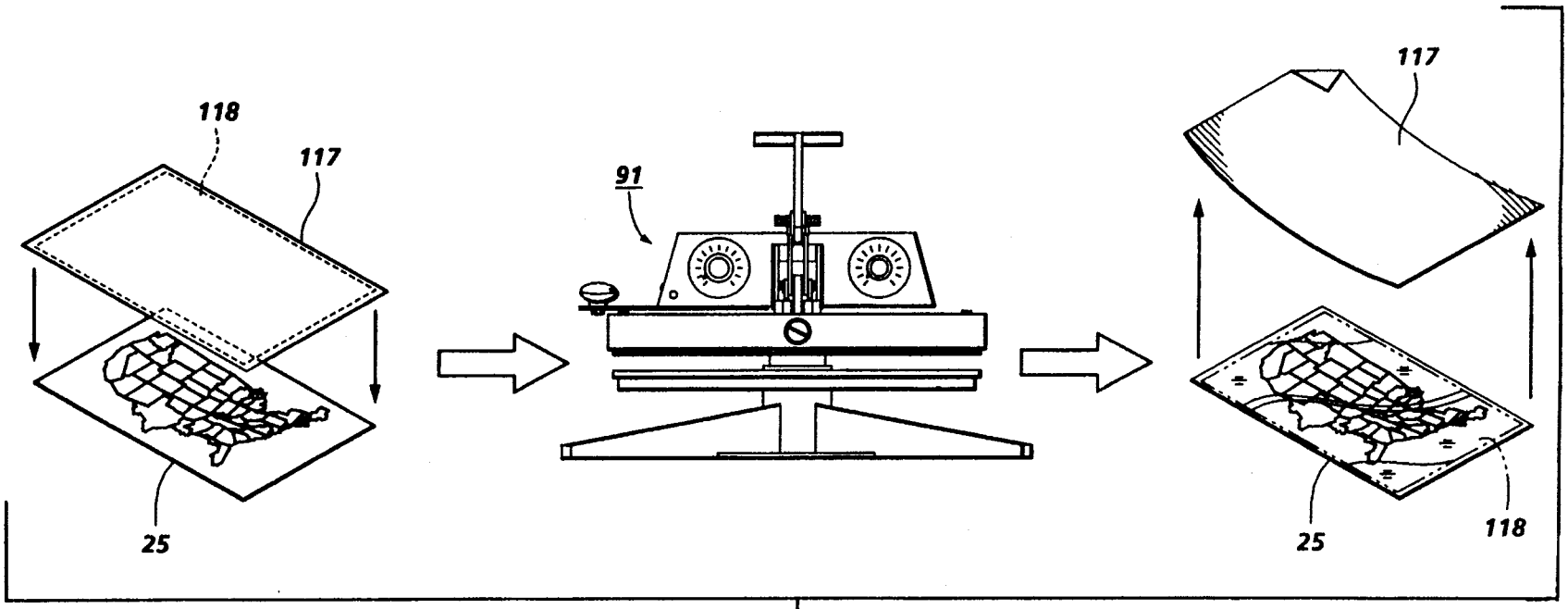
FIG. 1 is a schematic illustration of a device and materials for making glossed xerographic images or simulated photographic prints using the principles of xerography.

While the present invention will hereinafter be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

For a general understanding of the features of the present invention, reference is made to the drawings. In the drawings, like references have been used throughout to designate identical elements.

A schematic representation of the high-gloss coating process of the present invention is shown in FIG. 1. The process includes the steps of: providing a xerographic image on, for example, a paper sheet 25; providing a pre-cut carrier sheet 117 with a dry gloss coat coating 118 on one surface thereof and sandwiching the carrier sheet on top of the paper sheet with the gloss coat coating on the carrier sheet being in contact with the image on the paper sheet; inserting the sandwiched materials into a heater device 91; applying a predetermined amount of heat and pressure to the sandwiched materials; removing the sandwiched materials from the heater device; and removing the carrier sheet 117 from the paper sheet 25 thereby revealing a high-gloss protective coating on the paper sheet image 25. The imaged sheet can be of textured or matte finish with equally pleasing results. In addition, the toner on the imaged sheet can be applied by a dry or liquid development process. The carrier sheet can be selected from a number of materials suitable for this purpose, such as, crosslinked silicon resins. The dry gloss coat coating 118 on carrier sheet 117 is preferably an ethylene/vinyl acetate copolymer. The vinyl acetate is preferably selected in the amount range of from about 30 to about 45, and preferably about 35 percent by weight with from about 55 to about 70 and preferably 65 weight percent of ethylene. The composition ratio and molecular weight of the coating polymer can effect the final properties of the film. For example, at a give molecular weight, increasing the vinyl acetate amount will increase gloss, increase tackiness and decrease toughness. Increasing the ethylene amount will increase toughness, decrease gloss and decrease tackiness. Also, at a given composition ratio, increasing the molecular weight of the copolymer will increase toughness, decrease gloss and decrease tackiness. Coating thickness can vary, for example, from about 1 to about 10 microns.

Examples of polymers that may be selected include those that result in high gloss and smoothness with a low melt point (optimum). It may be easiest to meet these criteria with ethylene/vinyl acetate copolymers. Other polymers which it is believed would provide similar properties include polyesters of the SPAR TM family, such as, SPAR I TM, SPAR II TM: fumarates and terephthates with polyethylene oxide or polypropylene oxide bisphenol-A's or mixtures of the two; ethylene/ethyl acrylate copolymers or ethylene/ethyl acrylate/hexyl acrylate terpolymers; long chain polyamides like Versamids; Polyterpenes, for example, 75 to 90 percent by weight, Piccolytes; and Styrene/butadiene block copolymers with a high level of butadiene. A suitable gloss coating is disclosed in Japanese reference JP 3050720 B2 directed to a transferring method.

Figure 2:
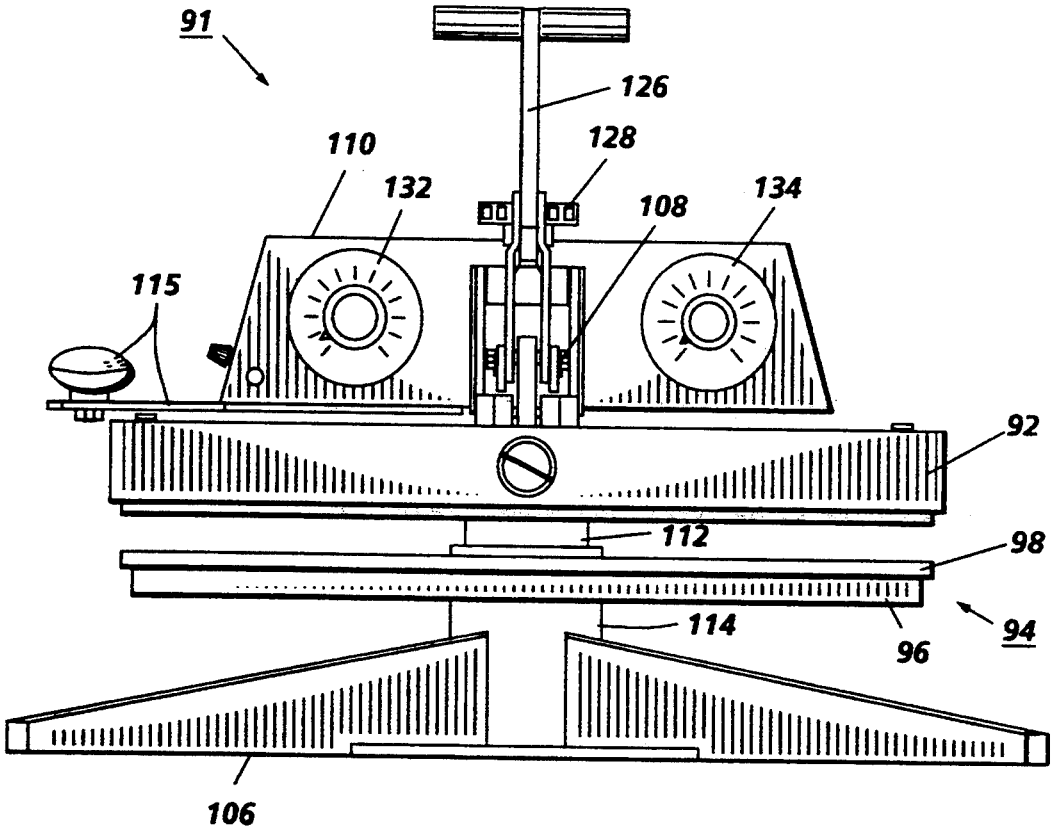
FIG. 2 is a front elevational view of a conventional heater device for making glossed xerographic images or simulated photographic prints using the principles of xerography.
Figure 3:
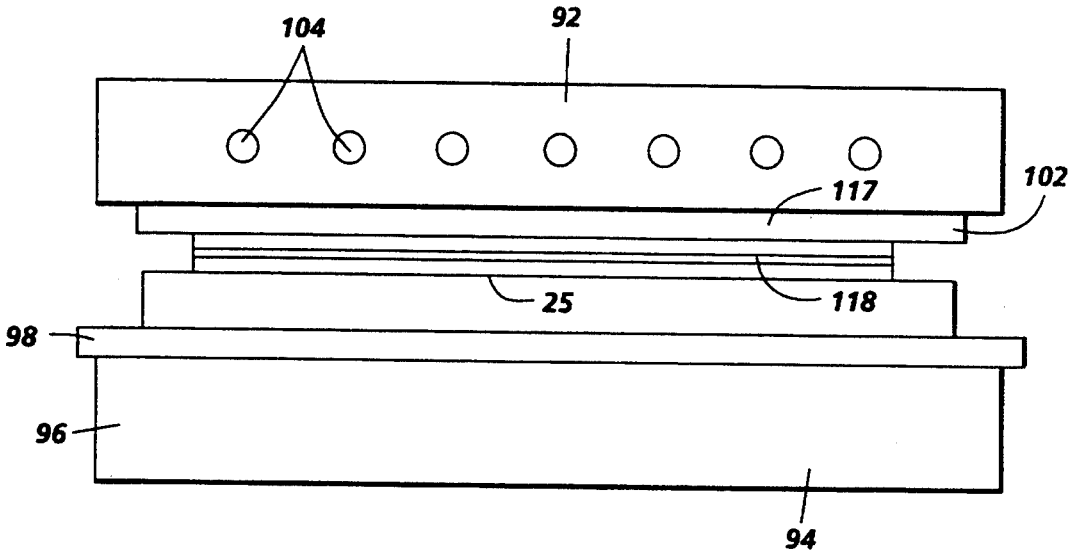
FIG. 3 is a enlarged partial front view of the heater device of FIG. 2.

A conventional heating device 91 usable with the high-gloss coating process of the present invention (FIGS. 2 and 3) includes upper and lower platen structures 92 and 94, respectively. The lower platen comprises a rigid metal plate or base member 96 containing a silicone rubber pad 98 having a thickness of approximately 0.5 inch. The upper platen 92 contains a heater structure 102 including heating elements 104 (FIG. 3).

The plate or base member 96 is provided with a leg structure 106 for supporting the heating device 91 on a suitable work surface such as a table. The upper platen 92 is hingedly secured via hinge structure 108 to an upper platen support structure 110. The support structure 110 is, in turn, operatively supported by a post member 112 received in a cylindrically shaped receiver member 114 forming an integral part of the plate or base member 96. The support structure is adapted to be pivoted relative to the base member 96 through the use of an arm and knob arrangement 115 attached to the support structure 110. The upper heated platen can thus be rotated either to the left or right (as viewed in FIG. 1) from its home position overlying rubber pad 98 in order to provide easy access thereto for inserting the material to be glossed.

A suitable transparent carrier substrate 117 with a release agent included thereon is commercially available from Xerox Corporation, Rochester, N.Y. under the Reorder No. 3R3108. A releasable coating is placed onto the carrier substrate for release to an imaged sheet. It can be the same coating that is on the B sheet sold by Xerox for use in the heretofore mentioned T-shirt printing process. In experimentation, the coating was removed from the B sheet by placing it and a transparent sheet that is coated with a release agent into a heating device with the coating facing the transparency. They were heated for about 10 to 15 seconds at 320° F. and removed from the heating device. The B sheet was peeled from the transparency with the adhesive coating having been transferred to the transparency. The transparency is now ready to be used in coating printed matter in general.

The hinge mechanism 108 is located centrally of the upper platen 92 and serves to allow movement of the upper platen 92 relative to the support structure 110, such movement being toward the lower platen 94 for exerting pressure on the carrier sheet 117 and imaged copy sheet 25 supported on the rubber pad 98. Movement of the upper platen is effected through the use of a lever arm 126 adapted to be moved in a direction out of the drawing sheet as viewed in FIG. 2.

Pressure variation or adjustment is effected through a pressure adjusting knob 128 and suitable linkage, not shown. The adjustment of the knob through its associated linkage mechanism serves to control the amount of pressure exerted between the upper and lower platens when the lever arm 126 is actuated.

An electric cord, not shown, provides electrical current to the heating elements 104. The heating elements and thus the operating temperature of the print creation structure 91 is controlled via a temperature control 132 carried by the support structure 110 as shown in FIG. 2. The operating temperature of the device is in the range of 220° to 450° F. The pressure and heat are applied for between 15 to 20 seconds depending on the weight of the imaged document, the time being settable via a timer knob 134.

During formation of a high-gloss onto an imaged sheet, the adhesive gloss coated transparent substrate 117 and imaged sheet 25 are subjected to a total pressure in the order of 5 to 10 pounds over the area of $8\frac{1}{2}\times 11$ and $11\times 17$ inch sheets. The time substrates 117 and 25 are left in the heating device 91 and temperature are dependent upon the different weights of imaged sheets. Typically, 16 and 20 pound imaged sheets are placed into heating device 91 for 15 seconds at a temperature of 345° to 347° F. Once the substrate 117 and imaged sheet 25 are removed from the heating device 91, the substrate is peeled from the imaged sheet leaving the coating which has now adhered to the image on the imaged member and thus creating a high-glossed imaged sheet.

Although the preferred embodiment of the carrier sheet or base stock 117 has been described as being a transparency, it should be understood that this may not be the most cost effective option. The functions needed are an ultra smooth surface when a gloss surface is needed plus an appropriate release coating. The base stock may be different if a matte or other textured surface is required.

Figure 4:
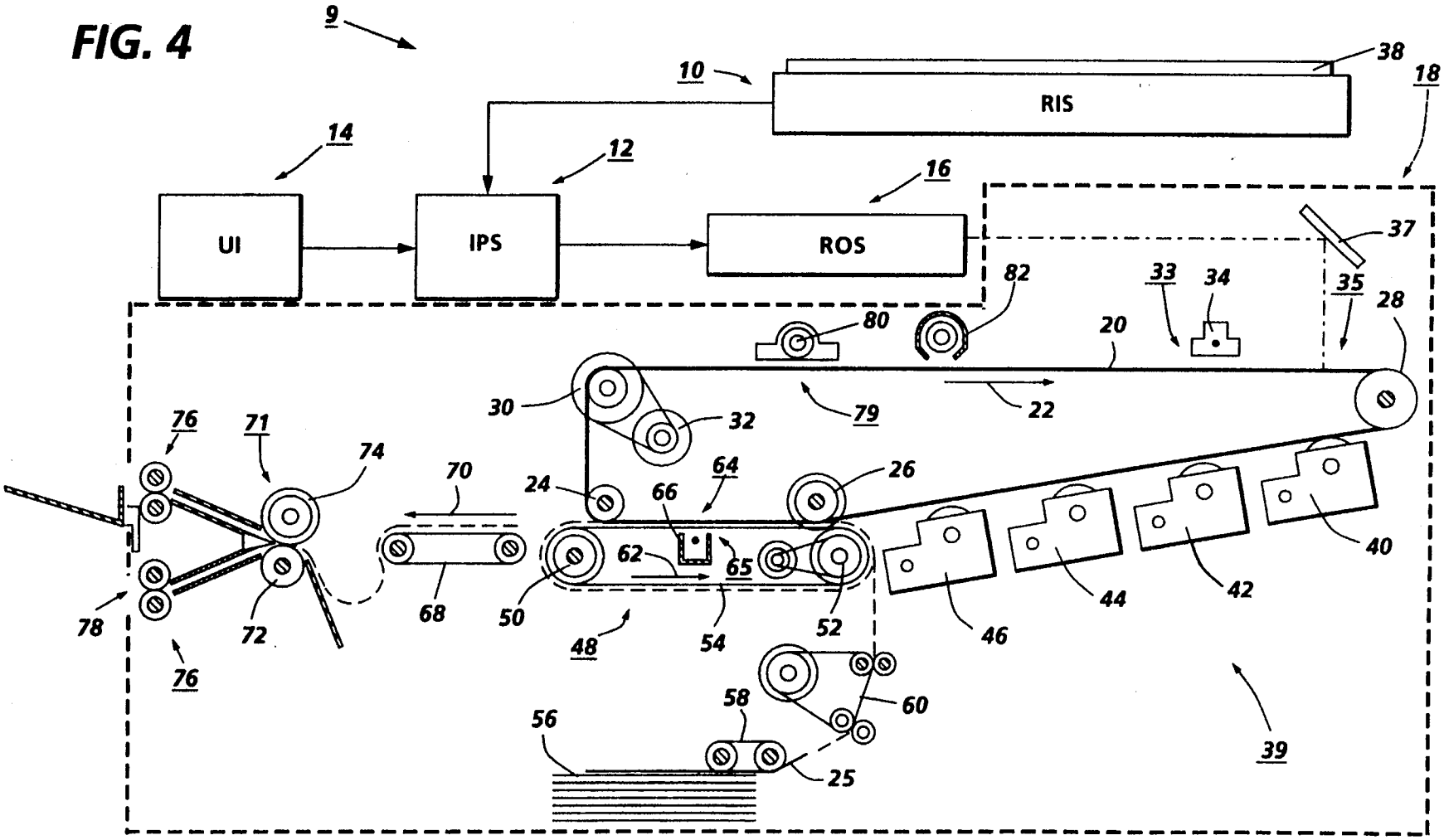
FIG. 4 is a schematic illustration of an imaging apparatus suitable for use in carrying out the present invention.

FIG. 4 is a schematic elevational view of an illustrative electrophotographic copier which may be utilized in carrying out the present invention. It will become evident from the following discussion that the present invention is equally well suited for use in a wide variety of printing systems, and is not necessarily limited in its application to the particular system shown herein.

Turning to FIG. 4, during operation of a printing system 9, a multi-color original document or photograph 38 is positioned on a raster input scanner (RIS), indicated generally by the reference numeral 10. The RIS contains document illumination lamps, optics, a mechanical scanning drive, and a charge coupled device (CCD array). The RIS captures the entire original document and converts it to a series of raster scan lines and measures a set of primary color densities, i.e. red, green and blue densities, at each point of the original document. This information is transmitted to an image processing system (IPS), indicated generally by the reference numeral 12. IPS 12 contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The output signal from UI 14 is transmitted to IPS 12. Signals corresponding to the desired image are transmitted from IPS 12 to a ROS 16, which creates the output image. ROS 16 lays out the image in a series of horizontal scan lines with each line having a specified number of pixels per inch. ROS 16 includes a laser having a rotating polygon mirror block associated therewith. ROS 16 is utilized for exposing a uniformly charged photoconductive belt 20 of a marking engine, indicated generally by the reference numeral 18, to achieve a set of subtractive primary latent images. The latent images are developed with cyan, magenta, and yellow developer material, respectively. These developed images are transferred to a final substrate in superimposed registration with one another to form a multi-color image on the substrate. This multi-color image is then heat and pressure fused to the substrate thereby forming a multi-color toner image thereon.

The printing system 9 is capable of printing conventional right reading toner images on plain paper or mirror images on various other kinds of substrates as will be discussed hereinafter. Mirror or reverse reading images on final substrates are effected through programed use of the UI 14.

The features of the printing system hereinabove described are utilized in the commercially available 5775 TM copier.

With continued reference to FIG. 4, printer or marking engine 18 is an electrophotographic printing machine. Photoconductive belt 20 of marking engine 18 is preferably made from a polychromatic photoconductive material. The photoconductive belt moves in the direction of arrow 22 to advance successive portions of the photoconductive surface sequentially through the various processing stations disposed about the path of movement thereof. Photoconductive belt 20 is entrained about transfer rollers 24 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform electrostatic potential.

Next, the charged photoconductive surface is moved through an exposure station, indicated generally by the reference numeral 35. Exposure station 35 receives a modulated light beam corresponding to information derived by RIS 10 having a multi-color original document 38 positioned thereat. RIS 10 captures the entire image from the original document 38 and converts it to a series of raster scan lines which are transmitted as electrical signals to IPS 12. The electrical signals from RIS 10 correspond to the red, green and blue densities at each point in the original document. IPS 12 converts the set of red, green and blue density signals, i.e. the set of signals corresponding to the primary color densities of original document 38, to a set of colorimetric coordinates. The operator actuates the appropriate keys of UI 14 to adjust the parameters of the copy. UI 14 may be a touch screen, or any other suitable control panel, providing an operator interface with a system. The output signals from UI 14 are transmitted to IPS 12. The IPS then transmits signals corresponding to the desired image to ROS 16. ROS 16 includes a laser with rotating polygon mirror block. Preferably, a nine facet polygon is used. ROS 16 illuminates, via mirror 37, the charged portion of photoconductive belt 20 at a rate of about 400 pixels per inch. The ROS will expose the photoconductive belt to record three latent images. One latent image is developed with cyan developer material. Another latent image is developed with magenta developer material and the third latent image is developed with yellow developer material. The latent images formed by ROS 16 on the photoconductive belt correspond to the signals transmitted from IPS 12.

According to the present invention, the document 38 preferably comprises a black and white or color document. It will be appreciated that various other documents may be employed without departing from the scope and true spirit of the invention, e.g., photographic prints, transparencies, etc..

After the electrostatic latent images have been recorded on photoconductive belt 20, the belt advances such latent images to a development station, indicated generally by the reference numeral 39. The development station includes four individual developer units indicated by reference numerals 40, 42, 44 and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface. Developer units 40, 42, and 44, respectively, apply toner particles of a specific color which corresponds to a compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document. Each of the developer units is moved into and out of an operative position. In the operative position, the magnetic brush is closely adjacent the photoconductive belt, while in the non-operative position, the magnetic brush is spaced therefrom. In FIG. 4, developer unit 40 is shown in the operative position with developer units 42, 44 and 46 being in the non-operative position. During development of each electrostatic latent image, only one developer unit is in the operative position, the remaining developer units are in the non-operative position. This ensures that each electrostatic latent image is developed with toner particles of the appropriate color without commingling.

It will be appreciated by those skilled in the art that scavengeless or non-interactive development systems well known in the art could be used in lieu of magnetic brush developer structures. The use of non-interactive developer systems for all but the first developer housing would make it unnecessary for movement of the developer housings relative to the photoconductive imaging surface.

After development, the toner image is moved to a transfer station, indicated generally by the reference numeral 65. Transfer station 65 includes a transfer zone, generally indicated by reference numeral 64. In transfer zone 64, the toner image is transferred to a transparent substrate 25. At transfer station 65, a substrate transport apparatus, indicated generally by the reference numeral 48, moves the substrate 25 into contact with photoconductive belt 20. Substrate transport 48 has a pair of spaced belts 54 entrained about a pair of substantially cylindrical rollers 50 and 52. A substrate gripper (not shown) extends between belts 54 and moves in unison therewith. The substrate 25 is advanced from a stack of substrates 56 disposed on a tray. A friction retard feeder 58 advances the uppermost substrate from stack 56 onto a pre-transfer transport 60. Transport 60 advances substrate 25 to substrate transport 48. Substrate 25 is advanced by transport 60 in synchronism with the movement of substrate gripper (not shown). In this way, the leading edge of substrate 25 arrives at a preselected position, i.e. a loading zone, to be received by the open substrate gripper. The substrate gripper then closes securing substrate 25 thereto for movement therewith in a recirculating path. The leading edge of substrate 25 is secured releasably by the substrate gripper. As belts 54 move in the direction of arrow 62, the substrate moves into contact with the photoconductive belt, in synchronism with the toner image developed thereon. At transfer zone 64, a corona generating device 66 sprays ions onto the backside of the substrate so as to charge the substrate to the proper electrostatic voltage magnitude and polarity for attracting the toner image from photoconductive belt 20 thereto. The substrate remains secured to the substrate gripper so as to move in a recirculating path for three cycles. In this way, three different color toner images are transferred to the substrate in superimposed registration with one another to form a composite multi-color image 67.

One skilled in the art will appreciate that the substrate may move in a recirculating path for four cycles when under color removal and black generation is used and up to eight cycles when the information on two original documents is being merged onto a single substrate. Each of the electrostatic latent images recorded on the photoconductive surface is developed with the appropriately colored toner and transferred, in superimposed registration with one another, to the substrate to form a multi-color facsimile of the colored original document. As may be appreciated, the imaging process is not limited to the creation of color images. Thus, high quality black and white copies and simulated photographic prints may also be created using the process disclosed herein.

After the last transfer operation, the substrate gripper opens and releases the substrate 25. A conveyor 68 transports the substrate, in the direction of arrow 70, to a heat and pressure fusing station, indicated generally by the reference numeral 71, where the transferred toner image is permanently fused to the substrate. The fusing station includes a heated fuser roll 74 and a pressure roll 72. The substrate passes through the nip defined by fuser roll 74 and pressure roll 72. The toner image contacts fuser roll 74 so as to be affixed to the transparent substrate. Thereafter, the substrate is advanced by a pair of rolls 76 to an outlet opening 78 through which substrate 25 is conveyed to a processor to be discussed hereinafter.

The last processing station in the direction of movement of belt 20, as indicated by arrow 22, is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

The simulated gloss process of the present invention has many advantages over processes that employ film lamination, spray-on gloss materials, press applied varnish or pre-coated papers that do not perform well in most xerographic copiers/printers. For example, image enhancement is obtained in that smooth or textured surfaces can be glossed. Also, adhesion of toner to the surface of a sheet is enhanced for both solid and liquid images since the toned image is exposed to heat a second time. The durability of an imaged sheet is enhanced because the gloss treatment provides improved resistance to damage on the imaged surface from handling or contamination. Further, post fuser sheet curl is minimized on single sided documents. And one can use copies made by this process with styrene-acrylate based toners in vinyl ring binders without vinyl offset.

It should be appreciated that while the high-gloss process of the present invention is disclosed in an off-line environment, it is contemplated that a high-gloss could be given to each imaged sheet on-line as the sheet leaves an imaging apparatus by employing the carrier substrate configured in roll form with a gloss adhesive on it downstream from the exit of the imaging apparatus. A heating device would be placed downstream of the carrier substrate and after the gloss adhesive has adhered to the sheet, a take-up roll could decouple the carrier substrate from the imaged sheet with the imaged sheet being subsequently deposited in an output tray. Also, while a transparency is disclosed herein as the base stock on which the releasable adhesive is attached, it should be understood that other stock can be used as long as the functions of an ultra smooth surface when a gloss surface is needed plus an appropriate release coating. The base stock may be different, for example, if a matte or other textured surface is required.

While creation of simulated photographic prints has been disclosed in connection with one specific apparatus it will be appreciated that other apparatuses may be utilized for this purpose. For example, the transparent substrate and backing sheet may be bonded together using a pair of heat and pressure rolls forming a nip through which the substrate and sheet are passed.

What is claimed is:

1. Method of forming a high-gloss xerographic image, comprising the steps of:

xerographically forming a toner image on an opaque sheet;

providing a transparent carrier substrate with an adhesive coating on one side thereof;

contacting said toner image on said opaque sheet with said one side of said transparent carrier substrate;

simultaneously applying heat and pressure at predetermined values to said transparent carrier substrate and said opaque sheet whereby said adhesive coating of said transparent carrier substrate melts and adheres to said toner image on said opaque sheet to form said high-gloss xerographic image; and separating said transparent carrier substrate from said opaque sheet.

2. The method according to claim 1, wherein said step of simultaneously applying heat and pressure comprises positioning said carrier substrate and said imaged opaque sheet between a pair of platens at least one of which is provided with a source of heat energy capable of elevating the temperature of said transparent carrier substrate and said imaged opaque sheet.

3. The method according to claim 2, wherein said step of applying pressure is effected by applying a force to one of said platens in order to urge it in the direction of the other of said platens.

4. The method according to claim 1, wherein said adhesive coating on said transparent substrate comprises polyesters.

5. The method according to claim 4, wherein the polyester is obtained from the reaction of propoxylated bisphenol A, and an unsaturated dicarboxylic acid.

6. The method according to claim 1, wherein said adhesive coating on said transparent substrate comprises an ethylene/vinyl copolymer.

7. The method according to claim 1, wherein said adhesive coating is comprised of an ethylene/vinyl acrylate/hexyl acrylate terpolymer.

8. The method according to claim 1, wherein said adhesive coating on said transparent substrate comprises long chained polyamides.

9. The method according to claim 1, wherein said adhesive coating on said transparent substrate comprises polyterpenes.

10. The method according to claim 1, wherein said adhesive coating on said transparent substrate comprises ethylene/vinyl acetate copolymers with an ethylene content of from about 55 to about 70 weight percent and a vinyl acetate content of from about 30 to about 45 weight percent.

11. The method according to claim 1, wherein said adhesive coating on said transparent substrate comprises styrene/butadiene block copolymers.

12. The method according to claim 11, wherein said copolymer coating is butadiene in an amount of from about 75 to about 90 percent by weight.

13. The process of making high-gloss xerographic images, comprising the steps of: providing a xerographically imaged paper sheet; providing a pre-cut carrier sheet with a dry gloss coat coating on one surface thereof and sandwiching the carrier sheet on top of the imaged sheet with the gloss coat coating on the carrier sheet being in contact with the image on the imaged sheet; inserting the sandwiched materials into a heater device; applying a predetermined amount of heat and pressure to the sandwiched materials; removing the sandwiched materials from the heater device; and removing the carrier sheet from the paper sheet thereby revealing a high-gloss protective coating on the paper sheet image.

14. The method according to claim 13, wherein said step of simultaneously applying heat and pressure comprises positioning said carrier substrate and said imaged opaque sheet between a pair of platens at least one of which is provided with a source of heat energy capable of elevating the temperature of said transparent carrier substrate and said imaged opaque sheet.

15. The method according to claim 14, wherein said step of applying pressure is effected by applying a force to one of said platens in order to urge it in the direction of the other of said platens.

16. Method of forming high-gloss xerographic images of photographs, said method including the steps of:

xerographically forming a toner image on an opaque sheet of a photograph;

providing a transparent carrier substrate with an adhesive coating on one side thereof;

contacting said toner image on said opaque sheet with said one side of said transparent carrier substrate;

simultaneously applying heat and pressure at predetermined values to said transparent carrier substrate and said opaque sheet whereby said adhesive coating of said toner image on said transparent carrier substrate melts and adheres to said opaque sheet to form said high-gloss xerographic image; and separating said transparent carrier substrate from said opaque sheet.

17. The method according to claim 16, wherein said step of simultaneously applying heat and pressure comprises positioning said carrier substrate and said imaged opaque sheet between a pair of platens at least one of which is provided with a source of heat energy capable of elevating the temperature of said transparent carrier substrate and said imaged opaque sheet.

18. The method according to claim 17, wherein said step of applying pressure is effected by applying a force to one of said platens in order to urge it in the direction of the other of said platens.

19. Method of forming a high-gloss, protective coating on toner images, said method including the steps of:

providing a toner image on a support material;

providing a carrier substrate with an adhesive coating on one side thereof;

contacting said toner image on said support material with said one side of said carrier substrate;

simultaneously applying heat and pressure at predetermined values to said carrier substrate and said toner image on said support material whereby said adhesive coating of said carrier substrate melts and adheres to said toner image on said support material to form the high-gloss, protective coating on said image; and separating said carrier substrate from said support material.

20. The method according to claim 19, wherein said step of providing a carrier substrate with an adhesive coating on one side thereof includes said carrier substrate being a transparency with a release agent thereon.

21. The method according to claim 19, wherein said adhesive coating on one side of said carrier substrate is an ethylene/vinyl acetate copolymer.

22. The method according to claim 21, wherein said copolymer is present in a thickness of from about 1 to 10 microns.

23. The method according to claim 21, wherein said copolymer contains an ethylene content of from about 55 to about 70 weight percent and a vinyl acetate content of from about 30 to about 45 weight percent.

* * * * *